US009779738B2

(12) United States Patent
Mundt et al.

(10) Patent No.: US 9,779,738 B2
(45) Date of Patent: Oct. 3, 2017

(54) EFFICIENT ENCODING AND DECODING OF MULTI-CHANNEL AUDIO SIGNAL WITH MULTIPLE SUBSTREAMS

(71) Applicants: DOLBY INTERNATIONAL AB, Amsterdam Zuidoost (NL); Dolby Laboratories Licensing Corporation, San Francisco, CA (US)

(72) Inventors: Harald Mundt, Fürth (DE); Jeffrey Riedmiller, Penngrove, CA (US); Karl J. Roeden, Solna (SE); Michael Ward, San Francisco, CA (US); Phillip Williams, Alameda, CA (US)

(73) Assignees: Dolby Laboratories Licensing Corporation, San Francisco, CA (US); Dolby International AB, Amsterdam Zuidoost (NL)

( * ) Notice: Subject to any disclaimer, the term of this patent is extended or adjusted under 35 U.S.C. 154(b) by 73 days.

(21) Appl. No.: 14/398,967

(22) PCT Filed: May 14, 2013

(86) PCT No.: PCT/US2013/040919
§ 371 (c)(1),
(2) Date: Nov. 4, 2014

(87) PCT Pub. No.: WO2013/173314
PCT Pub. Date: Nov. 21, 2013

(65) Prior Publication Data

US 2015/0131800 A1 May 14, 2015

Related U.S. Application Data

(60) Provisional application No. 61/647,226, filed on May 15, 2012.

(51) Int. Cl.
*H04R 5/00* (2006.01)
*G10L 19/008* (2013.01)
(Continued)

(52) U.S. Cl.
CPC ..... *G10L 19/008* (2013.01); *G10L 19/032* (2013.01); *H04S 3/008* (2013.01); *G10L 19/24* (2013.01)

(58) Field of Classification Search
CPC ..... G10L 19/008; G10L 19/24; G10L 19/032; H04S 3/008
(Continued)

(56) References Cited

U.S. PATENT DOCUMENTS 5,956,674 A 9/1999 Smyth
5,978,762 A * 11/1999 Smyth ..... G10L 19/0208 704/200.1
(Continued)

FOREIGN PATENT DOCUMENTS

CN 1647156 7/2005
CN 1756086 4/2006
(Continued)

OTHER PUBLICATIONS

ATSC "Digital Audio Compression Standard" (AC-3, E-AC-3), Nov. 22, 2010, published by the Advanced Television Systems Committee, Inc., Washington, D.C.
(Continued)

*Primary Examiner* — Paul S Kim

(57) ABSTRACT

The present document relates to audio encoding/decoding. In particular, the present document relates to a method and system for improving the quality of encoded multi-channel audio signals. An audio encoder configured to encode a multi-channel audio signal according to a total available data-rate is described. The multi-channel audio signal is
(Continued)

representable as a basic group (121) of channels for rendering the multi-channel audio signal in accordance to a basic channel configuration, and as an extension group (122) of channels, which—in combination with the basic group (122)—is for rendering the multi-channel audio signal in accordance to an extended channel configuration. The basic channel configuration and the extended channel configuration are different from one another.

15 Claims, 8 Drawing Sheets

(51) Int. Cl.
*H04S 3/00* (2006.01)
*G10L 19/032* (2013.01)
*G10L 19/24* (2013.01)

(58) Field of Classification Search
USPC ..... 381/22, 23
See application file for complete search history.

(56) References Cited

U.S. PATENT DOCUMENTS

| | | | | |
|---|---|---|---|---|
| 6,044,396 | A | 3/2000 | Adams | |
| 6,195,388 | B1 | 2/2001 | Choi | |
| 6,493,388 | B1 | 12/2002 | Wang | |
| 6,931,372 | B1 | 8/2005 | Sinha | |
| 6,956,901 | B2 | 10/2005 | Boroczky | |
| 7,302,000 | B2 | 11/2007 | Chen | |
| 7,516,230 | B2 | 4/2009 | Sperschneider | |
| 2007/0225842 | A1* | 9/2007 | Smith | H04S 3/00 700/94 |
| 2009/0144792 | A1 | 6/2009 | Fielibert | |
| 2010/0324915 | A1 | 12/2010 | Seo | |
| 2011/0035507 | A1 | 2/2011 | Brueck | |
| 2011/0142125 | A1 | 6/2011 | Tripathi | |
| 2011/0176600 | A1 | 7/2011 | Wang | |

FOREIGN PATENT DOCUMENTS

| | | |
|---|---|---|
| CN | 1805290 | 7/2006 |
| EP | 1796081 | 6/2007 |
| JP | S63-182700 | 7/1988 |
| JP | 07-058707 | 3/1995 |
| JP | H08-123488 | 5/1996 |
| JP | 2002-541524 | 12/2002 |
| JP | 2003-533154 | 11/2003 |
| JP | 2010-156837 | 7/2010 |
| JP | 2011-008258 | 1/2011 |
| JP | 2011-048279 | 3/2011 |
| TW | 200737125 | 10/2007 |
| WO | 01/87015 | 11/2001 |

OTHER PUBLICATIONS

Fielder, L.D. et al. "Introduction to Dolby Digital Plus, an Enhancement to the Dolby Digital Coding System", presented at the 117th AES Convention, Oct. 28-31, 2004.

ETSI TS 103 366 "Digital Audio Compression (AC-3, Enhanced AC-3)Standard" Sophia Antipolis Cedex, France, vol. BC, No. V1.1.1. Feb. 1, 2005.

* cited by examiner

EFFICIENT ENCODING AND DECODING OF MULTI-CHANNEL AUDIO SIGNAL WITH MULTIPLE SUBSTREAMS

CROSS-REFERENCE TO RELATED APPLICATIONS

This application claims the benefit of priority to U.S. Provisional Patent Application Ser. No. 61/647,226 filed on 15 May 2012, hereby incorporated by reference in its entirety.

TECHNICAL FIELD OF THE INVENTION

The present document relates to audio encoding/decoding. In particular, the present document relates to a method and system for improving the quality of encoded multi-channel audio signals.

BACKGROUND OF THE INVENTION

Various multi-channel audio rendering systems such as 5.1, 7.1 or 9.1 multi-channel audio rendering systems are currently in use. The multi-channel audio rendering systems allow for the generation of a surround sound originating from 5+1, 7+1 or 9+1 speaker locations, respectively. For an efficient transmission or for an efficient storing of the corresponding multi-channel audio signals, multi-channel audio codec (encoder/decoder) systems such as Dolby Digital or Dolby Digital Plus are being used. These multi-channel audio codec systems are typically downward compatible in order to allow a N.1 multi-channel audio decoder (e.g., N=5) to decode and render at least part of an M.1 multi-channel audio signal (e.g., M=7), with M being greater than N. More particularly, the bitstreams generated by the multi-channel audio codec systems are typically downward compatible in order to allow a N.1 multi-channel audio decoder (e.g., N=5) to decode and render at least part of an M.1 multi-channel audio signal (e.g., M=7). By way of example, an encoded bitstream of a 7.1 multi-channel audio signal should be decodable by a 5.1 multi-channel audio decoder. A possible way to implement such downward compatibility is to encode a M.1 multi-channel audio signal into a plurality of substreams (e.g., into an independent substream (hereinafter referred to as "IS") and into one or more dependent substreams (hereinafter referred to as "DS")). The IS may comprise a basic encoded N.1 multi-channel audio signal (e.g., an encoded 5.1 audio signal) and the one or more DS may comprise replacement and/or extension channels for rendering the full M.1 multi-channel audio signal (as will be outlined in further detail below). Furthermore, the bitstream may comprise multiple IS (i.e., a plurality of independent substreams) each having one or more associated DS. The plurality of IS and associated DS may, for example, be used to carry a plurality of different broadcast programs or a plurality of associated audio tracks (such as for different languages or for directors comments, etc.), respectively.

The present document addresses the aspect of an efficient encoding of a plurality of substreams (e.g., an IS and one or more associated DS or a plurality of IS and respective one or more associated DS) of a multi-channel audio signal.

SUMMARY OF THE INVENTION

According to an aspect an audio encoder configured to encode a multi-channel audio signal according to a total available data-rate is described. The multi-channel audio signal may, for example, be a 9.1, 7.1 or 5.1 multi-channel audio signal. The audio encoder may be a frame-based audio encoder configured to encode a sequence of frames of the multi-channel audio signal, thereby yielding a corresponding sequence of encoded frames. In particular, the encoder may be configured to perform encoding according to the Dolby Digital Plus standard.

The multi-channel audio signal is representable as a basic group of channels for rendering the multi-channel audio signal in accordance to a basic channel configuration, and as an extension group of channels, which—in combination with the basic group—is for a rendering of the multi-channel audio signal in accordance to an extended channel configuration. Typically, the basic channel configuration and the extended channel configuration are different from one another. In particular, the extended channel configuration typically comprises a higher number of channels than the basic channel configuration. By way of example, the basic channel configuration and the basic group of channels may comprise N channels. The extension channel configuration may comprise M channels, with M being greater than N. In such cases, the extension group of channels may comprise one or more extension channels to extend the basic channel configuration to the extension channel configuration. Furthermore, the extension group of channels may comprise one or more replacement channels which replace one or more channels of the basic group of channels when rendered in the extension channel configuration.

In an embodiment, the multi-channel audio signal is a 7.1 audio signal comprising a center, left front, right front, left surround, right surround, left surround back, right surround back channel and a low frequency effects channel. In such cases, the basic group of channels may comprise the center, left front and right front channels, as well as a downmixed left surround channel and a downmixed right surround channel, thereby enabling the rendering of the multi-channel audio signal in a 5.1 channel configuration (the basic configuration). The downmixed left surround channel and the downmixed right surround channel may be derived from the left surround, right surround, left surround back, and right surround back channels (e.g., as a sum of some or all of the left surround, right surround, left surround back, and right surround back channels). The extension group of channels may comprise the left surround, right surround, left back, and right back channels, thereby enabling the rendering of the basic channels and the extension channels in a 7.1 channel configuration (the extended channel configuration). It should be noted that the above mentioned 7.1 channel configuration is only one example of possible 7.1 channel configurations. By way of example, the left surround and right surround channels may be labeled as left and right side channels (placed at +/−90 degrees with respect to a midline in front of the head of a listener). In a similar manner, the back channels may be referred to as left and right rear surround channels.

The audio encoder comprises a basic encoder configured to encode the basic group of channels according to an IS (independent substream) data-rate, thereby yielding an independent substream. The independent substream may comprise a sequence of IS frames comprising encoded data representative of the basic group of channels. Furthermore, the audio encoder comprises an extension encoder configured to encode the extension group of channels according to a DS (dependent substream) data-rate, thereby yielding a dependent substream. The dependent substream may comprise a sequence of DS frames comprising encoded data representative of the extension group of channels. In an embodiment, the basic encoder and/or the extension encoder are configured to perform Dolby Digital Plus encoding.

In addition, the audio encoder comprises a rate control unit configured to regularly adapt the IS data-rate and the DS data-rate based on a momentary IS coding quality indicator for the basic group of channels and/or based on a momentary DS coding quality indicator for the extension group of channels. The IS data-rate and the DS data-rate may be adapted such that the sum of the IS data-rate and the DS data-rate substantially corresponds to (e.g., is equal to) the total available data-rate. In particular, the rate control unit may be configured to determine the IS data-rate and the DS data-rate such that a difference between the momentary IS coding quality indicator and the momentary DS coding quality indicator is reduced. This may result in improved audio quality for the combination of the basic group and the extended group of channels under the constraint of the available total bitrate.

The momentary IS coding quality indicator and/or the momentary DS coding quality indicator may be indicative of a coding complexity of the multi-channel audio signal at a particular time instant. By way of example, the multi-channel audio signal may be represented as a sequence of audio frames. In such cases, the momentary IS coding quality indicator and/or the momentary DS coding quality indicator may be indicative of a complexity for encoding one or more audio frames of the multi-channel audio signal. As such, the momentary IS coding quality indicator and/or the momentary DS coding quality indicator may vary from frame to frame. Hence the rate control unit may be configured to adapt the IS data-rate and the DS data-rate from frame to frame (depending on the varying momentary IS coding quality indicator and/or the momentary DS coding quality indicator). In other words, the rate control unit may be configured to adapt the IS data-rate and the DS data-rate for each frame of the sequence of frames of the multi-channel audio signal.

The momentary IS coding quality indicator and/or the momentary DS coding quality indicator may comprise an encoding parameter of the basic encoder and/or the extension encoder, respectively. By way of example, in case of Dolby Digital Plus encoding, the momentary IS coding quality indicator and/or the momentary DS coding quality indicator may comprise the momentary SNR offset of the basic encoder and/or the extension encoder, respectively. Alternatively or in addition, the IS coding quality indicator may comprise one or more of: a perceptual entropy of a current (first) frame of the basic group; a tonality of the first frame of the basic group; a transient characteristic of the first frame of the basic group; a spectral bandwidth of the first frame of the basic group; a presence of transients in the first frame of the basic group; a degree of correlation between channels of the basic group; and an energy of the first frame of the basic group. In a similar manner, the DS coding quality indicator may comprise one or more of: a perceptual entropy of the first frame of the extension group; a tonality of the first frame of the extension group; a transient characteristic of the first frame of the extension group; a spectral bandwidth of the first frame of the extension group; a presence of transients in the first frame of the extension group; a degree of correlation between channels of the extension group; and an energy of the first frame of the extension group.

In case of a frame-based audio encoder, the basic encoder may be configured to determine a sequence of IS frames for the sequence of frames of the multi-channel signal. In a similar manner, the extension encoder may be configured to determine a sequence of DS frames for the sequence of frames of the multi-channel signal. In such cases, the IS coding quality indicator may comprise a sequence of IS coding quality indicators for the corresponding sequence of IS frames. In a similar manner, the DS coding quality indicator may comprise a sequence of DS coding quality indicators for the corresponding sequence of DS frames. The rate control unit may then be configured to determine the IS data-rate for an IS frame of the sequence of IS frames and the DS data-rate for a DS frame of the sequence of DS frames based on at least one of the sequence of IS coding quality indicators and/or based on at least one of the sequence of DS coding quality indicators. The IS data-rate for an IS frame and the DS data-rate for the corresponding DS frame may be adapted such that the sum of the IS data-rate for the IS frame and the DS data-rate for the corresponding DS frame is substantially the total available data-rate for an audio frame of the multi-channel audio signal.

The encoder may comprise a coding difficulty determination unit configured to determine the IS coding quality indicator based on a first frame of the basic group of channels, and/or to determine the DS coding quality indicator based on a corresponding first frame of the extension group of channels. The first frame may be the frame for which the IS data-rate and the DS data-rate is to be determined. As such, the coding difficulty determination unit may be configured to analyze the to-be-encoded frame of the basic group of channels and/or of the extension group of channels and determine the IS/DS coding quality indicators which may be used by the rate control unit to adapt the IS data-rate and the DS data-rate for the to-be-encoded frame.

The basic encoder may comprise a transform unit configured to determine a basic block of transform coefficients from the first frame of the basic group. In a similar manner, the extension encoder may comprise a transform unit configured to determine an extension block of transform coefficients from the corresponding first frame of the extension group. The transform units may be configured to apply a Time-To-Frequency transform, for example, a Modified Discrete Cosine Transform (MDCT). The first frame may be subdivided into a plurality of blocks (e.g., having an overlap) and the transform units may be configured to transform a block of samples derived from the respective first frames.

Furthermore, the basic encoder may comprise a floating-point encoding unit configured to determine a basic block of exponents and a basic block of mantissas from the basic block of transform coefficients. In a similar manner, the extension encoder may comprise a floating-point encoding unit configured to determine an extension block of exponents and an extension block of mantissas from the extension block of transform coefficients. The rate-control unit may be configured to determine a total number of available mantissa bits for encoding the basic block of mantissas and the extension block of mantissas, based on the total available data-rate. For this purpose, the rate-control unit may consider a total number of available bits derived from the total available data-rate and subtract a number of bits from the total number of available bits which are used for the encoding of the exponents and/or other encoding parameters which are not related to mantissas. The remaining bits may be the total number of available mantissa bits. Furthermore, the rate-control unit may be configured to distribute the total number of available mantissa bits to the basic block of mantissas and the extension block of mantissas, based on the momentary IS coding quality indicator and the momentary DS coding quality indicator, thereby adapting the IS data-rate and the DS data-rate.

In particular, the rate-control unit may be configured to determine a basic power spectral density (PSD) distribution for the basic block of transform coefficients. In a similar manner, the rate-control unit may determine an extension PSD distribution for the extension block of transform coefficients. Furthermore, the rate-control unit may determine a basic masking curve for the basic block of transform coefficients and an extension masking curve for the extension block of transform coefficients. The rate-control unit may use the basic PSD distribution, the extension PSD distribution, the basic masking curve and the extension masking curve for distributing the total number of available mantissa bits to the basic block of mantissas and the extension block of mantissas.

Even more particularly, the rate-control unit may be configured to determine an offset basic masking curve by offsetting the basic masking curve using an IS offset (also referred to as the "IS SNR offset"). In a similar manner, the rate-control unit may be configured to determine an offset extension masking curve by offsetting the extension masking curve using a DS offset (also referred to as the "DS SNR offset"). Furthermore, the rate-control unit may be configured to compare the basic PSD distribution and the offset basic masking curve, and allocate a basic number of mantissa bits to the basic block of mantissas, based on the result of the comparison. In addition, the rate-control unit may be configured to compare the extension PSD distribution and the offset extension masking curve, and allocate an extension number of mantissa bits to the extension block of mantissas, based on the result of the comparison.

A total number of allocated mantissa bits may be determined as the sum of the basic number of mantissa bits and the extension number of mantissa bits. The rate-control unit may then be configured to adjust the IS offset and the DS offset such that a difference of the total number of allocated mantissa bits and the total number of available mantissa bits is below a pre-determined bit threshold. For this purpose, the rate-control unit may make use of an iterative search scheme, in order to determine the IS offset and the DS offset which meet the above mentioned condition. In particular, the rate-control unit may be configured to adjust the IS offset and the DS offset, such that the IS offset and the DS offset are equal for the sequence of frames of the multi-channel audio signal, thereby adapting the IS data-rate and the DS data-rate for each frame of the sequence of frames of the multi-channel audio signal. As already indicated, the momentary IS coding quality indicator may comprise the IS offset and/or the momentary DS coding quality indicator may comprise the DS offset.

As such, the audio encoder may be configured to perform a joint bit allocation process for the basic group of channels and for the extension group of channels. In other words, the basic encoder and the extension encoder may make use of a combined bit allocation process, thereby adapting the IS data-rate and the DS data-rate on a regular basis (e.g., on a frame by frame basis).

The rate-control unit may be configured to determine the IS offset and the DS offset for the first frame of the multi-channel audio signal. By way of example, the IS offset and the DS offset may be extracted from an IS frame and a DS frame, respectively, at the output of the basic encoder and the extension encoder, respectively. Furthermore, the rate-control unit may be configured to adjust the IS data-rate and the DS data-rate for encoding a second frame of the multi-channel audio signal, based on the IS offset and the DS offset for the first frame. Typically, the first frame precedes the second frame. In particular, the second frame may directly follow the first frame, without any intermediate frame between the first and second frames. In other words, the IS offset and the DS offset used for a preceding, and possibly for a directly preceding, first frame may be used for determining the IS data-rate and the DS data-rate for encoding the current second frame. In yet other words, it is proposed to use an indication of the coding quality of the preceding first frame to adjust the IS data-rate and the DS data-rate for encoding the current second frame.

In particular, the rate-control unit may be configured to adjust the IS data-rate and the DS data-rate for encoding the second frame of the multi-channel audio signal, such that a difference between the IS offset and the DS offset is reduced (e.g., reduced in average across a plurality of audio frames). For this purpose a regulation loop may be used, wherein the regulation loop is adapted to regulate the difference between the IS offset and the DS offset. By way of example, the rate-control unit may be configured to determine the difference between the IS offset and the DS offset for the first frame. Furthermore, the rate-control unit may be configured to change the IS data-rate for the second frame compared to the IS data-rate for the first frame by a rate offset, and change the DS data-rate for the second frame compared to the DS data-rate for the first frame by the negative rate offset. The rate offset (in particular the sign of the rate offset) may depend on the determined difference.

The audio encoder may be configured to encode a plurality of (associated) multi-channel audio signals. Each multi-channel audio signal of the plurality of signals may, for example, correspond to a different broadcast program or to a different language. This may be beneficial for Digital Video Disks (DVD) providing a plurality of different multi-channel audio signals (e.g., different languages) for a movie. The plurality of (associated) multi-channel audio signals may have corresponding frames (representing corresponding time intervals of the plurality of associated multi-channel audio signals). Each of the plurality of multi-channel audio signals may be representable as a basic group of channels for rendering the respective multi-channel audio signal in accordance to the basic channel configuration, thereby providing a plurality of basic groups. Furthermore, each of the plurality of multi-channel audio signals may be representable as an extension group of channels, which—in combination with the basic group—is for rendering the respective multi-channel audio signal in accordance to the extended channel configuration, thereby providing a plurality of extension groups.

The audio encoder may comprise a plurality of basic encoders for encoding the plurality of basic groups according to a plurality of IS data-rates, thereby yielding a respective plurality of IS. It should be noted that a combined basic encoder may be configured to encode the plurality of basic groups to yield the respective plurality of IS. In a similar manner, the audio encoder may comprise a plurality of extension encoders for encoding the plurality of extension groups according to a plurality of DS data-rates, thereby yielding a respective plurality of DS. It should be noted that a combined extension encoder may be configured to encode the plurality of extension groups to yield the respective plurality of DS.

The rate control unit may then be configured to regularly adapt the plurality of IS data-rates and the plurality of DS data-rates based on one or more momentary IS coding quality indicators for the plurality of basic groups of channels and/or based on one or more momentary DS coding quality indicators for the plurality of extension groups of channels, such that the sum of the plurality of IS data-rates and the plurality of DS data-rates substantially corresponds to the total available data-rate. The momentary coding quality indicators may e.g., be the SNR offsets for encoding the plurality of basic groups/extension groups. In particular, the rate control unit may be configured to apply the rate allocation/bit allocation schemes described in the present document to a plurality of IS and a corresponding plurality of DS. As such, each IS and each DS may have varying data-rates (e.g., varying from frame to frame), while the overall bit-rate for the plurality of encoded multi-channels audio signals (i.e., for the plurality of IS and DS) remains constant.

According to another aspect, a method for encoding a multi-channel audio signal according to a total available data-rate is described. The multi-channel audio signal may be representable as a basic group of channels for rendering the multi-channel audio signal in accordance to a basic channel configuration, and as an extension group of channels, which—in combination with the basic group—is for rendering the multi-channel audio signal in accordance to an extended channel configuration. The basic channel configuration and the extended channel configuration may be different from one another.

The method may comprise encoding the basic group of channels according to an IS data-rate, thereby yielding an independent substream. The method may further comprise encoding the extension group of channels according to a DS data-rate, thereby yielding a dependent substream. In addition, the method may comprise regularly adapting the IS data-rate and the DS data-rate based on a momentary IS coding quality indicator for the basic group of channels and/or based on a momentary DS coding quality indicator for the extension group of channels, such that the sum of the IS data-rate and the DS data-rate substantially corresponds to the total available data-rate.

The method may further comprise determining the IS coding quality indicator based on an excerpt of the basic group of channels, and/or determining the DS coding quality indicator based on a corresponding excerpt of the extension group of channels. The excerpt of the basic group/extension group may, for example, be one or more frames of the basic group/extension group. As such, the IS coding quality indicator and/or the DS coding quality indicator may be determined based on the input signal to an audio encoder. By way of example, the coding quality indicators may be determined based on a perceptual entropy of the excerpt of the basic/extension group; based on a tonality of the excerpt of the basic/extension group; based on a transient characteristic of the excerpt of the basic/extension group; based on a spectral bandwidth of the excerpt of the basic/extension group; a presence of transients in the excerpt of the basic/extension group; a degree of correlation between channels of the basic/extension group; and/or based on an energy of the excerpt of the basic/extension group.

Alternatively or in addition, the IS coding quality indicator may be indicative of a perceptual quality of an excerpt of the independent substream (i.e. of the perceptual quality of the encoded signal). In a similar manner, the DS coding quality indicator may be indicative of a perceptual quality of an excerpt of the dependent substream (i.e. of the perceptual quality of the encoded signal).

In such cases, adapting the IS data-rate and the DS data-rate may comprise adapting the IS data-rate and the DS data-rate for encoding the excerpt of the independent substream and the excerpt of the dependent substream, such that an absolute difference between the IS coding quality indicator and the DS coding quality indicator is below a difference threshold. By way of example, the difference threshold may be substantially zero. As outlined above, the adapting of the IS data-rate and the DS data-rate may be achieved by using a joint bit allocation when encoding the excerpt of the independent substream and the excerpt of the dependent substream.

Alternatively, adapting the IS data-rate and the DS data-rate may comprise adapting the IS data-rate and the DS data-rate for encoding a further excerpt of the independent substream and a corresponding further excerpt of the dependent substream, based on a difference between the IS coding quality indicator and the DS coding quality indicator. The further excerpts of the basic and extension groups may be subsequent to the excerpts of the basic and extension groups. By way of example, the further excerpts of the basic and extension groups may directly follow, without intermediate excerpts, the excerpts of the basic and extension groups. As such, the IS data-rate and Ds data-rate may be adapted from excerpt to excerpt, based on fed back IS/DS coding quality indicator(s).

According to a further aspect, a software program is described. The software program may be adapted for execution on a processor and for performing the method steps outlined in the present document when carried out on the processor.

According to another aspect, a storage medium is described. The storage medium may comprise a software program adapted for execution on a processor and for performing the method steps outlined in the present document when carried out on the processor.

According to a further aspect, a computer program product is described. The computer program may comprise executable instructions for performing the method steps outlined in the present document when executed on a computer.

It should be noted that the methods and systems including its preferred embodiments as outlined in the present patent application may be used stand-alone or in combination with the other methods and systems disclosed in this document. Furthermore, all aspects of the methods and systems outlined in the present patent application may be arbitrarily combined. In particular, the features of the claims may be combined with one another in an arbitrary manner. In addition, although steps of methods may be provided in a particular order, the steps may be combined or performed out of the provided order.

DESCRIPTION OF THE FIGURES

The invention is explained below in an exemplary manner with reference to the accompanying drawings, wherein.

DETAILED DESCRIPTION OF THE INVENTION

Figure 1A:
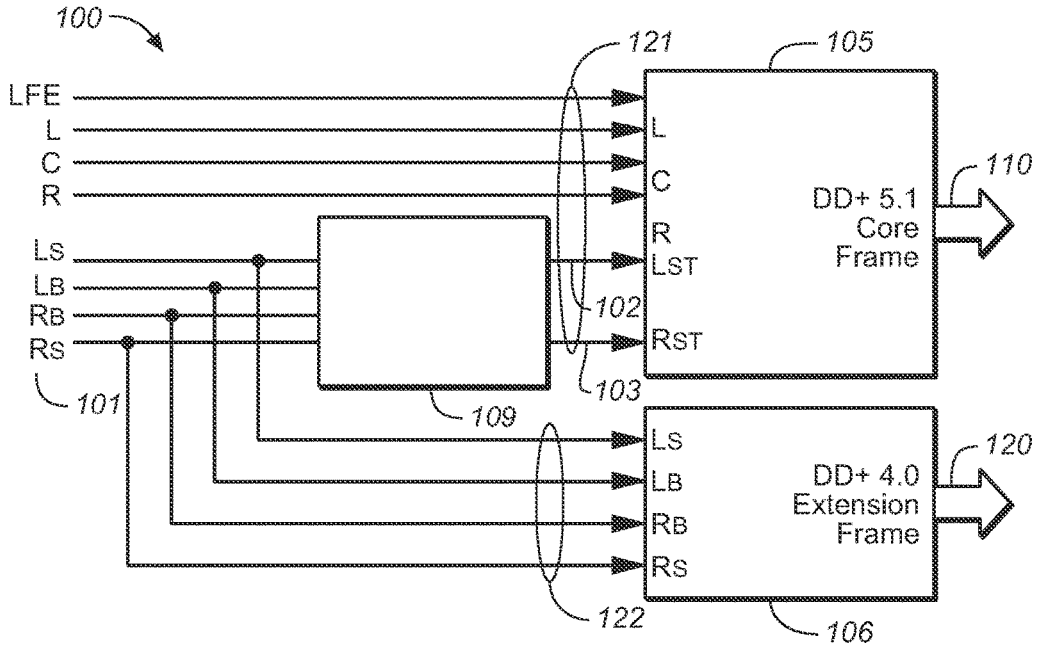
FIG. 1*a* shows a high level block diagram of an example multi-channel audio encoder.

As outlined in the introductory section, it is desirable to provide multi-channel audio codec systems which generate bitstreams that are downward compatible with regards to the number of channels which are decoded by a particular multi-channel audio decoder. In particular, it is desirable to encode an M.1 multi-channel audio signal such that it can be decoded by an N.1 multi-channel audio decoder, with N<M. By way of example, it is desirable to encode a 7.1 audio signal such that it can be decoded by a 5.1 audio decoder. In order to allow for downward compatibility, multi-channel audio codec systems typically encode an M.1 multi-channel audio signal into an independent (sub)stream ("IS"), which comprises a reduced number of channels (e.g., N.1 channels), and into one or more dependent (sub)streams ("DS"), which comprise replacement and/or extension channels in order to decode and render the full M.1 audio signal.

In this context, it is desirable to allow for an efficient encoding of the IS and the one or more DS. The present document describes methods and systems which enable the efficient encoding of an IS and one or more DS, while at the same time maintaining the independence of the IS and the one or more DS in order to maintain the downward compatibility of the multi-channel audio codec system. The methods and systems are described based on the Dolby Digital Plus (DD+) codec system (also referred to as enhanced AC-3). The DD+ codec system is specified in the Advanced Television Systems Committee (ATSC) "Digital Audio Compression Standard (AC-3, E-AC-3)", Document A/52:2010, dated 22 Nov. 2010, the content of which is incorporated by reference. It should be noted, however, that the methods and systems described in the present document are generally applicable and may be applied to other audio codec systems which encode multi-channel audio signals into a plurality of substreams.

Frequently used multi-channel configurations (and multi-channel audio signals) are the 7.1 configuration and the 5.1 configuration. A 5.1 multi-channel configuration typically comprises an L (left front), a C (center front), an R (right front), an Ls (left surround), an Rs (right surround), and an LFE (Low Frequency Effects) channel. A 7.1 multi-channel configuration further comprises a Lb (left surround back) and a Rb (right surround back) channel. An example 7.1 multi-channel configuration is illustrated in FIG. 2*b*. In order to transmit 7.1 channels in DD+, two substreams are used. The first substream (referred to as the independent substream, "IS") comprises a 5.1 channel mix, and the second substream (referred to as the dependent substream, "DS") comprises extension channels and replacement channels. For example, in order to encode and transmit a 7.1 multi-channel audio signal with surround back channels Lb and Rb, the independent substream carries the channels L (left front), C (center front), R (right front), Lst (left surround downmixed), Rst (right surround downmixed), LFE (Low Frequency Effects), and the dependent channel carries the extension channels Lb (left surround back), Rb (right surround back) and the replacement channels Ls (left surround), Rs (right surround). When a full 7.1 signal decode is performed, the Ls and Rs channels from the dependent substream replace the Lst and Rst channels from the independent substream.

FIG. 1*a* shows a high level block diagram of an example DD+7.1 multi-channel audio encoder 100 illustrating the relationship between 5.1 and 7.1 channels. The seven (7) plus one (1) audio channels 101 (L, C, R, Ls, Lb, Rs and Rb plus LFE) of the multi-channel audio signal are split into two groups of audio channels. A basic group 121 of channels comprises the audio channels L, C, R and LFE, as well as downmixed surround channels Lst 102 and Rst 103 which are typically derived from the 7.1 surround channels Ls, Rs and the 7.1 back channels Lb, Rb. By way of example, the downmixed surround channels 102, 103 are derived by adding some or all of the Lb and Rb channels and the 7.1 surround channels Ls, Rs in a downmix unit 109. It should be noted that the downmixed surround channels Lst 102 and Rst 103 may be determined in other ways. By way of example, the downmixed surround channels Lst 102 and Rst 103 may be determined directly from two of the 7.1 channels, for example, the 7.1 surround channels Ls, Rs.

Figure 1B:
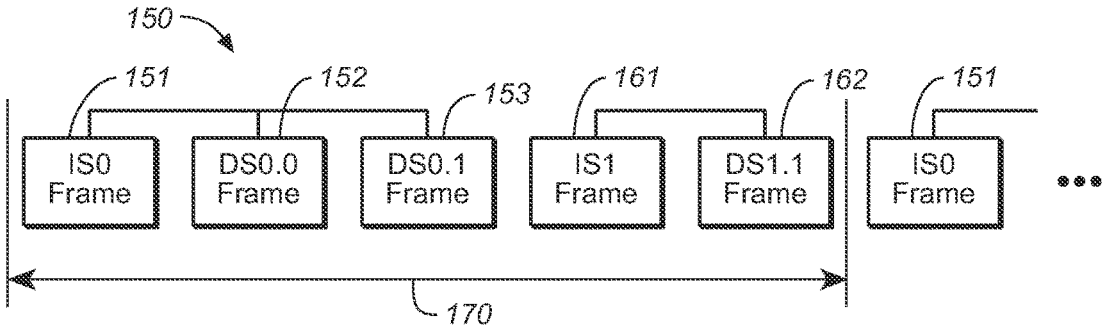
FIG. 1*b* shows an example sequence of encoded frames.

The basic group 121 of channels is encoded in a DD+5.1 audio encoder 105, thereby yielding the independent substream ("IS") 110 which is transmitted in a DD+ core frame 151 (see FIG. 1*b*). The core frame 151 is also referred to as an IS frame. A second group 122 of audio channels comprises the 7.1 surround channels Ls, Rs and the 7.1 surround back channels Lb, Rb. The second group 122 of channels is encoded in a DD+4.0 audio encoder 106, thereby yielding a dependent substream ("DS") 120 which is transmitted in one or more DD+ extension frame 152, 153 (see FIG. 1*b*). The second group 122 of channels is referred herein as the extension group 122 of channels and the extension frames 152, 153 are referred to as DS frames 152. 153.

FIG. 1*b* illustrates an example sequence 150 of encoded audio frames 151, 152, 153, 161, 162. The illustrated example comprises two independent substreams IS0 and IS1 comprising the IS frames 151 and 161, respectively. Multiple IS (and respective DS) may be used to provide multiple associated audio signals (e.g., for different languages of a movie or for different programs). Each of the independent substreams comprises one or more dependent substreams DS0, DS1, respectively. Each of the dependent substreams comprises respective DS frames 152, 153 and 162. Furthermore, FIG. 1*b* indicates the temporal length 170 of a complete audio frame of the multi-channel audio signal. The temporal length 170 of the audio frame may be 32 ms (e.g., at a sampling rate fs=48 kHz). In other words, FIG. 1*b* indicates the length in time 170 of an audio frame which is encoded into one or more IS frames 151, 161 and respective DS frames 152, 153, 162.

Figure 2A:
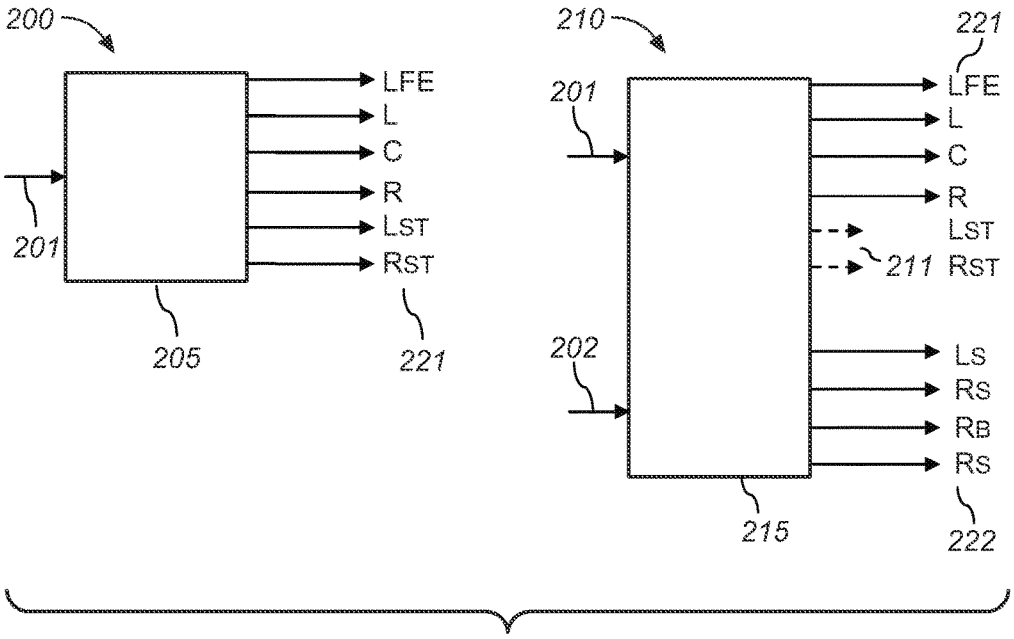
FIG. 2*a* shows a high level block diagram of example multi-channel audio decoders.
Figure 2B:
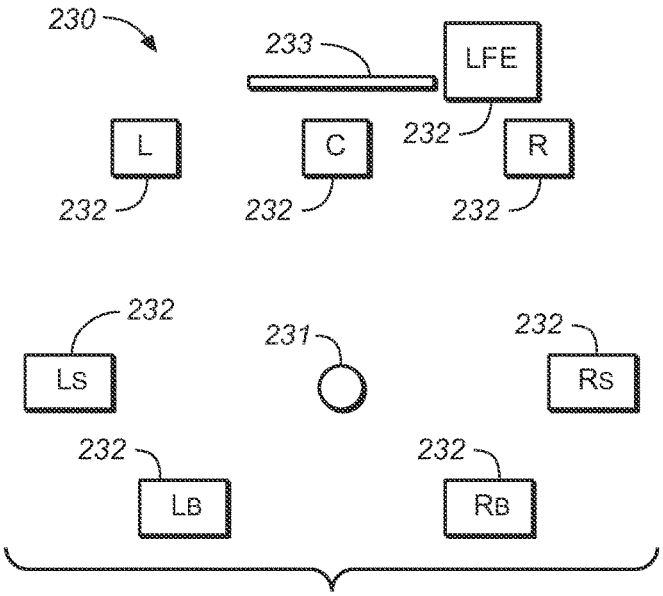
FIG. 2*b* shows an example loudspeaker arrangement for a 7.1 multi-channel audio signal.

FIG. 2*a* illustrates high level block diagrams of example multi-channel decoder systems 200, 210. In particular, FIG. 2*a* shows an example 5.1 multi-channel decoder system 200 which receives the encoded IS 201 comprising the encoded basic group 121 of channels. The encoded IS 201 is taken from the IS frames 151 of a received bitstream (e.g., using a demultiplexer which is not shown). The IS frames 151 comprise the encoded basic group 121 of channels and are decoded using a 5.1 multi-channel decoder 205, thereby yielding a decoded 5.1 multi-channel audio signal comprising the decoded basic group 221 of channel. Furthermore, FIG. 2*a* shows an example 7.1 multi-channel decoder system 210 which receives the encoded IS 201 comprising the encoded basic group 121 of channels and the encoded DS 202 comprising the encoded extension group 122 of channels. As outlined above, the encoded IS 201 may be taken from the IS frames 151 and the encoded DS 202 may be taken from the DS frames 152, 153 of the received bitstream (e.g., using a demultiplexer which is not shown). After decoding, a decoded 7.1 multi-channel audio signal comprising the decoded basic group 221 of channels and a decoded extension group 222 of channels is obtained. It should be noted that the downmixed surround channels Lst, Rst 211 may be dropped, as the 7.1 multi-channel decoder 215 makes use of the decoded extension group 222 of channels instead. Typical rendering positions 232 of a 7.1 multi-channel audio signal are shown in the multi-channel configuration 230 of FIG. 2*b*, which also illustrates an example position 231 of a listener and an example position 233 of a screen for video rendering.

Currently, the encoding of 7.1 channel audio signals in DD+ is performed by a first core 5.1 channel DD+ encoder 105 and a second DD+ encoder 106. The first DD+ encoder 105 encodes the 5.1 channels of the basic group 121 (and may therefore be referred to as a 5.1 channel encoder) and the second DD+ encoder 106 encodes the 4.0 channels of the extension group 122 (and may therefore be referred to as a 4.0 channel encoder). The encoders 105, 106 for the basic group 121 and the extension group 122 of channels typically do not have any knowledge of each other. Each of the two encoders 105, 106 is provided with a data-rate, which corresponds to a fixed portion of the total available data-rate. In other words, the encoder 105 for the IS and the encoder 106 for the DS are provided with a fixed fraction of the total available data-rate (e.g., X % of the total available data-rate for the IS encoder 105 (referred to as the "IS data-rate") and 100%−X % of the total available data-rate for the DS encoder 106 (referred to as the "DS data-rate"), e.g., X=50). Using the respectively assigned data-rates (i.e., the IS data-rate and the DS data-rate), the IS encoder 105 and the DS encoder 106 perform an independent encoding of the basic group 121 of channels and of the extension group 122 of channels, respectively.

In the present document, it is proposed to create a dependency between the IS encoder 105 and the DS encoder 106 and to thereby increase the efficiency of the overall multi-channel encoder 100. In particular, it is proposed to provide an adaptive assignment of the IS data-rate and the DS data-rate based on the characteristics or conditions of the basic group 121 of channels and the extension group 122 of channels.

Figure 3:
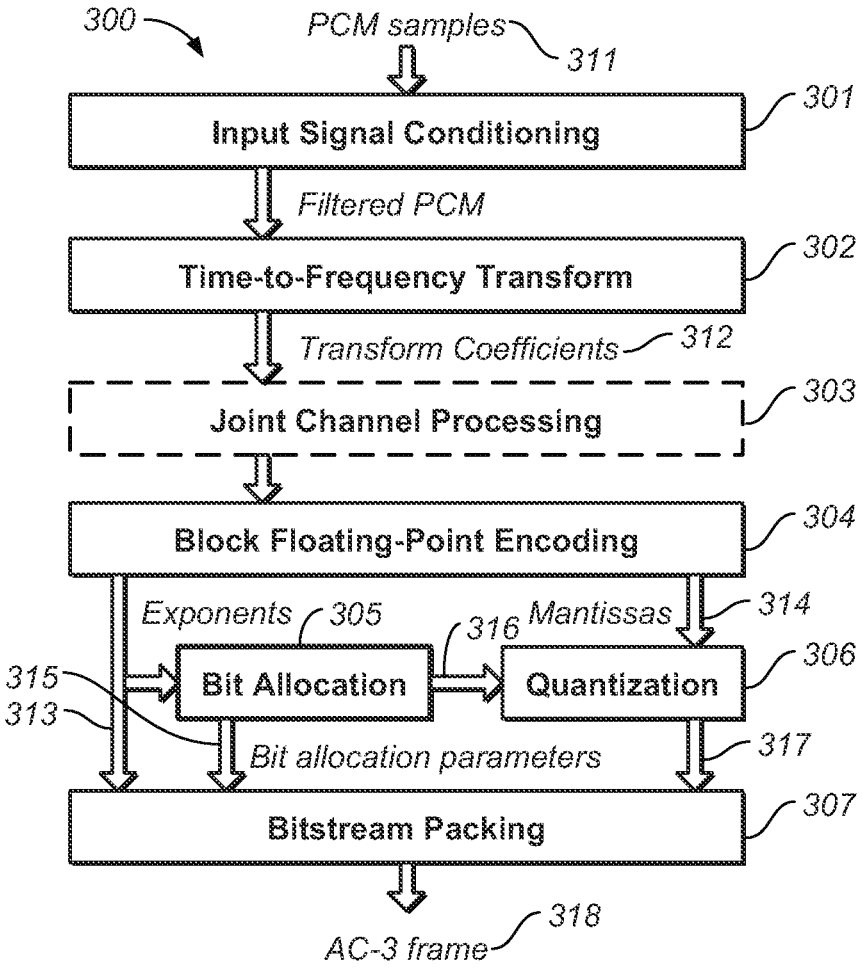
FIG. 3 illustrates a block diagram of example components of a multi-channel audio encoder.

In the following, further details regarding the components of the IS encoder 105 and the DS encoder 106 are described in the context of FIG. 3, which shows a block diagram of an example DD+ multi-channel encoder 300. The IS encoder 105 and/or to the DS encoder 106 may be embodied by the DD+ multi-channel encoder 300 of FIG. 3. Subsequent to describing the components of the encoder 300, it is described how the multi-channel encoder 300 may be adapted to allow for the above mentioned adaptive assignment of the IS data-rate and the DS data-rate.

The multi-channel encoder 300 receives streams 311 of PCM samples corresponding to the different channels of the multi-channel input signal (e.g., of the 5.1 input signal). The streams 311 of PCM samples may be arranged into frames of PCM samples. Each of the frames may comprise a pre-determined number of PCM samples (e.g., 1536 samples) of a particular channel of the multi-channel audio signal. As such, for each time segment of the multi-channel audio signal, a different audio frame is provided for each of the different channels of the multi-channel audio signal. The multi-channel audio encoder 300 is described in the following for a particular channel of the multi-channel audio signal. It should be noted, however, that the resulting AC-3 frame 318 typically comprises the encoded data of all the channels of the multi-channel audio signal.

An audio frame comprising PCM samples 311 may be filtered in an input signal conditioning unit 301. Subsequently, the (filtered) samples 311 may be transformed from the time-domain into the frequency-domain in a Time-to-Frequency Transform unit 302. For this purpose, the audio frame may be subdivided into a plurality of blocks of samples. The blocks may have a pre-determined length L (e.g., 256 samples per block). Furthermore, adjacent blocks may have a certain degree of overlap (e.g., 50% overlap) of samples from the audio frame. The number of blocks per audio frame may depend on a characteristic of the audio frame (e.g., the presence of a transient). Typically, the Time-to-Frequency Transform unit 302 applies a Time-to-Frequency Transform (e.g., a MDCT (Modified Discrete Cosine Transform) Transform) to each block of PCM samples derived from the audio frame. As such, for each block of samples a block of transform coefficients 312 is obtained at the output of the Time-to-Frequency Transform unit 302.

Each channel of the multi-channel input signal may be processed separately, thereby providing separate sequences of blocks of transform coefficients 312 for the different channels of the multi-channel input signal. In view of correlations between some of the channels of the multi-channel input signal (e.g., correlations between the surround signals Ls and Rs), a joint channel processing may be performed in joint channel processing unit 303. In an example embodiment, the joint channel processing unit 303 performs channel coupling, thereby converting a group of coupled channels into a single composite channel plus coupling side information which may be used by a corresponding decoder system 200, 210 to reconstruct the individual channels from the single composite channel. By way of example, the Ls and Rs channels of a 5.1 audio signal may be coupled or the L, C, R, Ls, and Rs channels may be coupled. If coupling is used in unit 303, only the single composite channel is submitted to the further processing units shown in FIG. 3. Otherwise, the individual channels (i.e., the individual sequences of blocks of transform coefficients 312) are passed to the to further processing units of the encoder 300.

In the following, the further processing units of the encoder are described for an exemplary sequence of blocks of transform coefficients 312. The description is applicable to each of the channels which are to be encoded (e.g., to the individual channels of the multi-channel input signal or to one or more composite channels resulting from channel coupling).

The block floating-point encoding unit 304 is configured to convert the transform coefficients 312 of a channel (applicable to all channels, including the full bandwidth channels (e.g., the L, C and R channels), the LFE (Low Frequency Effects) channel, and the coupling channel) into an exponent/mantissa format. By converting the transform coefficients 312 into an exponent/mantissa format, the quantization noise which results from the quantization of the transform coefficients 312 can be made independent of the absolute input signal level.

Typically, the block floating-point encoding performed in unit 304 may convert each of the transform coefficients 312 into an exponent and a mantissa. The exponents are to be encoded as efficiently as possible in order to reduce the data-rate overhead required for transmitting the encoded exponents 313. At the same time, the exponents should be encoded as accurately as possible in order to avoid losing spectral resolution of the transform coefficients 312. In the following, an exemplary block floating-point encoding scheme is briefly described which is used in DD+ to achieve the above mentioned goals. For further details regarding the DD+ encoding scheme (and in particular, the block floating-point encoding scheme used by DD+) reference is made to the document Fielder, L. D. et al. "Introduction to Dolby Digital Plus, and Enhancement to the Dolby Digital Coding System", AEC Convention, 28-31 Oct. 2004, the content of which is incorporated by reference.

Figure 4A:
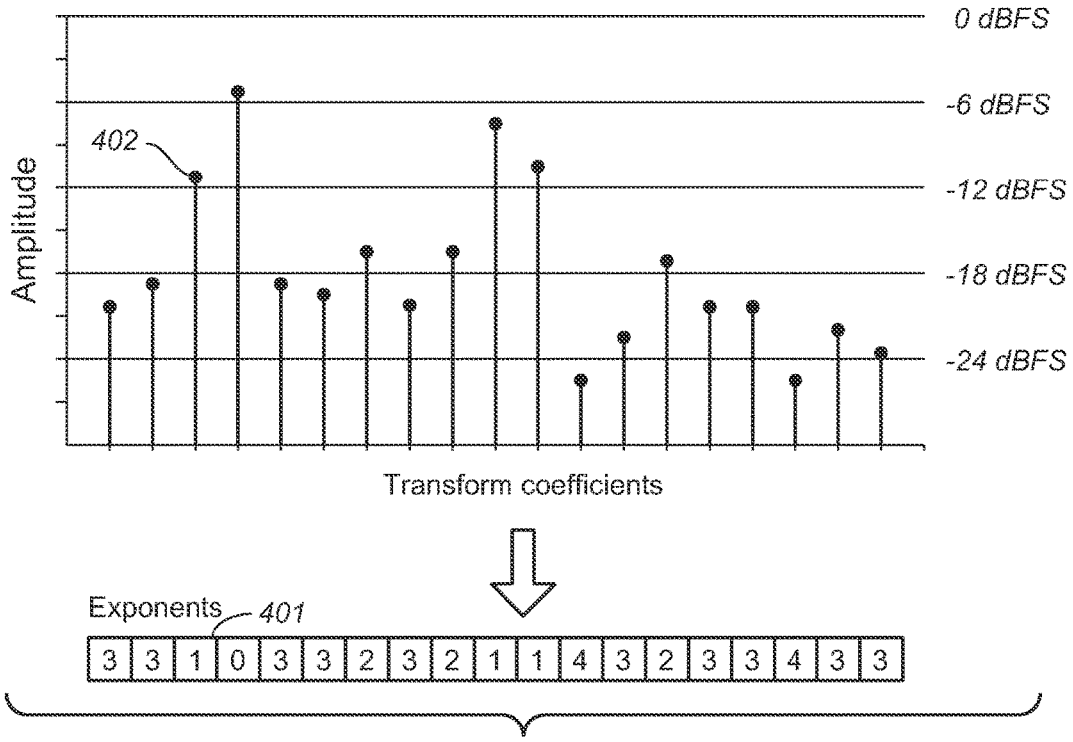
FIGS. 4*a* to 4*e* illustrate particular aspects of an example multi-channel audio encoder.

In a first step of block floating-point encoding, raw exponents may be determined for a block of transform coefficients 312. This is illustrated in FIG. 4*a*, where a block of raw exponents 401 is illustrated for an example block of transform coefficients 402. It is assumed that a transform coefficient 402 has a value X, wherein the transform coefficient 402 may be normalized such that X is smaller or equal to 1. The value X may be represented in a mantissa/exponent format X=m*2(−e), with m being the mantissa (m<=1) and e being the exponent. In an embodiment, the raw exponent 401 may take on values between 0 and 24, thereby covering a dynamic range of over 144 dB (i.e., 2(−0) to 2(−24)).

In order to further reduce the number of bits required for encoding the (raw) exponents 401, various schemes may be applied, such as time sharing of exponents across the blocks of transform coefficient 312 of a complete audio frame (typically six blocks per audio frame). Furthermore, exponents may be shared across frequencies (i.e., across adjacent frequency bins in the transform/frequency-domain). By way of example, an exponent may be shared across two or four frequency bins. In addition, the exponents of a block of transform coefficients 312 may be tented in order to ensure that the different between adjacent exponents does not exceed a pre-determined maximum value, e.g. +/−2. This allows for an efficient differential encoding of the exponents of a block of transform coefficients 312 (e.g., using five differentials). The above mentioned schemes for reducing the data-rate required for encoding the exponents (i.e., time sharing, frequency sharing, tenting and differential encoding) may be combined in different manners to define different exponent coding modes resulting in different data-rates used for encoding the exponents. As a result of the above mentioned exponent coding, a sequence of encoded exponents 313 is obtained for the blocks of transform coefficients 312 of an audio frame (e.g., six blocks per audio frame).

As a further step of the Block Floating-Point Encoding scheme performed in unit 304, the mantissas m' of the original transform coefficients 402 are normalized by the corresponding resulting encoded exponent e'. The resulting encoded exponent e' may be different from the above mentioned raw exponent e (due to time sharing, frequency sharing and/or tenting steps). For each transform coefficient 402 of FIG. 4*a*, the normalized mantissa m' may be determined as X=m'*2(−e'), wherein X is the value of the original transform coefficient 402. The normalized mantissas m' 314 for the blocks of the audio frame are passed to the quantization unit 306 for quantization of the mantissas 314. The quantization of the mantissas 314, i.e. the accuracy of the quantized mantissas 317, depends on the data-rate which is available for the mantissa quantization. The available data-rate is determined in the bit allocation unit 305.

The bit allocation process performed in unit 305 determines the number of bits which can be allocated to each of the normalized mantissas 314 in accordance with psychoacoustic principles. The bit allocation process comprises the step of determining the available bit count for quantizing the normalized mantissas of an audio frame. Furthermore, the bit allocation process determines a power spectral density (PSD) distribution and a frequency-domain masking curve (based on a psychoacoustic model) for each channel. The PSD distribution and the frequency-domain masking curve are used to determine a substantially optimal distribution of the available bits to the different normalized mantissas 314 of the audio frame.

The first step in the bit allocation process is to determine how many mantissa bits are available for encoding the normalized mantissas 314. The target data-rate translates into a total number of bits which are available for encoding a current audio frame. In particular, the target data-rate specifies a number k bits/s for the encoded multi-channel audio signal. Considering a frame length of T seconds, the total number of bits may be determined as T*k. The available number of mantissa bits may be determined from the total number of bits by subtracting bits that have already been used up for encoding the audio frame, such as metadata, block switch flags (for signaling detected transients and selected block lengths), coupling scale factors, exponents, etc. The bit allocation process may also subtract bits that may still need to be allocated to other aspects, such as bit allocation parameters 315 (see below). As a result, the total number of available mantissa bits may be determined. The total number of available mantissa bits may then be distributed among all channels (e.g., the main channels, the LFE channel, and the coupling channel) over all (e.g., one, two, three or six) blocks of the audio frame.

Figure 4B:
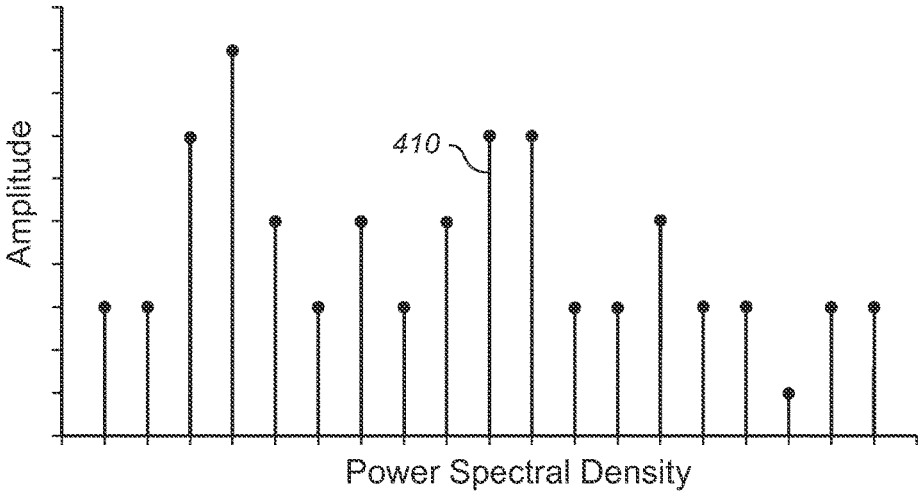
Figure 4C:
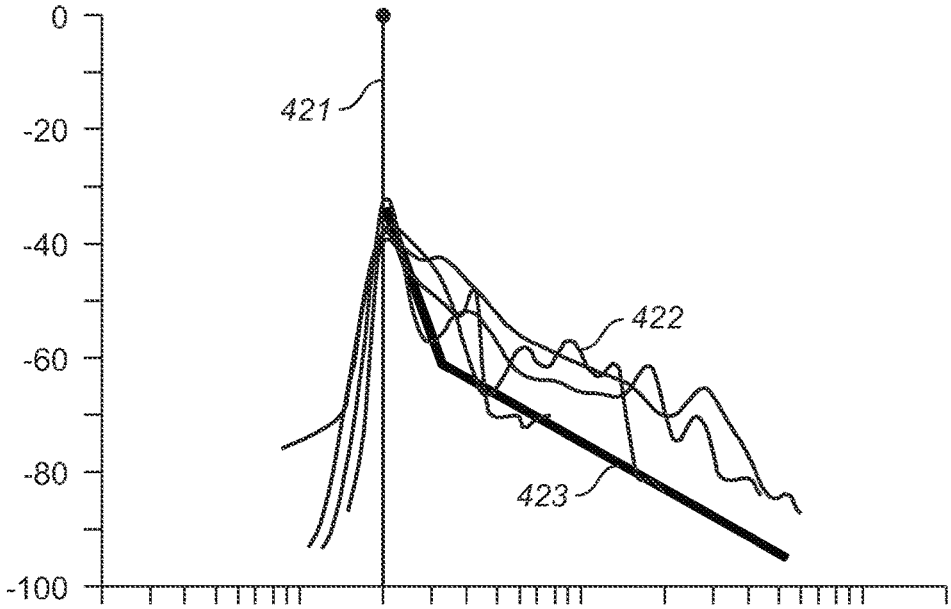

As a further step, the power spectral density ("PSD") distribution of the block of transform coefficients 312 may be determined. The PSD is a measure of the signal energy in each transform coefficient frequency bin of the input signal. The PSD may be determined based on the encoded exponents 313, thereby enabling the corresponding multi-channel audio decoder system 200, 210 to determine the PSD in the same manner as the multi-channel audio encoder 300. FIG. 4*b* illustrates the PSD distribution 410 of a block of transform coefficients 312 which has been derived from the encoded exponents 313. The PSD distribution 410 may be used to compute the frequency-domain masking curve 431 (see FIG. 4*d*) for the block of transform coefficients 312. The frequency-domain masking curve 431 takes into account psychoacoustic masking effects which describe the phenomenon that a masker frequency masks frequencies in the direct vicinity of the masker frequency, thereby rendering the frequencies in the direct vicinity of the masker frequency inaudible if their energy is below a certain masking threshold. FIG. 4*c* shows a masker frequency 421 and the masking threshold curve 422 for neighboring frequencies. The actual masking threshold curve 422 may be modeled by a (two-segment) (piecewise linear) masking template 423 used in the DD+ encoder.

It has been observed that the shape of masking threshold curve 422 (and by consequence also the masking template 423) remains substantially unchanged for different masker frequencies on a critical band scale as defined, for example, by Zwicker (or on a logarithmic scale). Based on this observation, the DD+ encoder applies the masking template 423 onto a banded PSD distribution (wherein the banded PSD distribution corresponds to the PSD distribution on the critical band scale where the bands are approximately half critical bands wide). In case of a banded PSD distribution a single PSD value is determined for each of a plurality of bands on the critical band scale (or on the logarithmic scale).

Figure 4D:
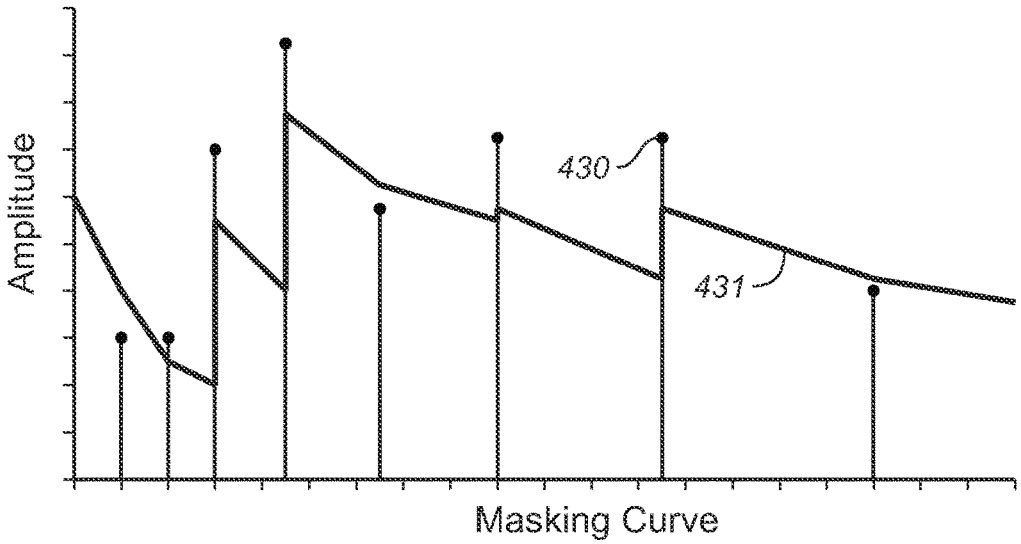

FIG. 4*d* illustrates an example banded PSD distribution 430 for the linear-spaced PSD distribution 410 of FIG. 4*b*. The banded PSD distribution 430 may be determined from the linear-spaced PSD distribution 410 by combining (e.g., using a log-add operation) PSD values from the linear-spaced PSD distribution 410 which fall within the same band on the critical band scale (or on the logarithmic scale). The masking template 423 may be applied to each PSD value of the banded PSD distribution 430, thereby yielding an overall frequency-domain masking curve 431 for the block of transform coefficients 402 on the critical band scale (or on the logarithmic scale) (see FIG. 4*d*).

Figure 4E:
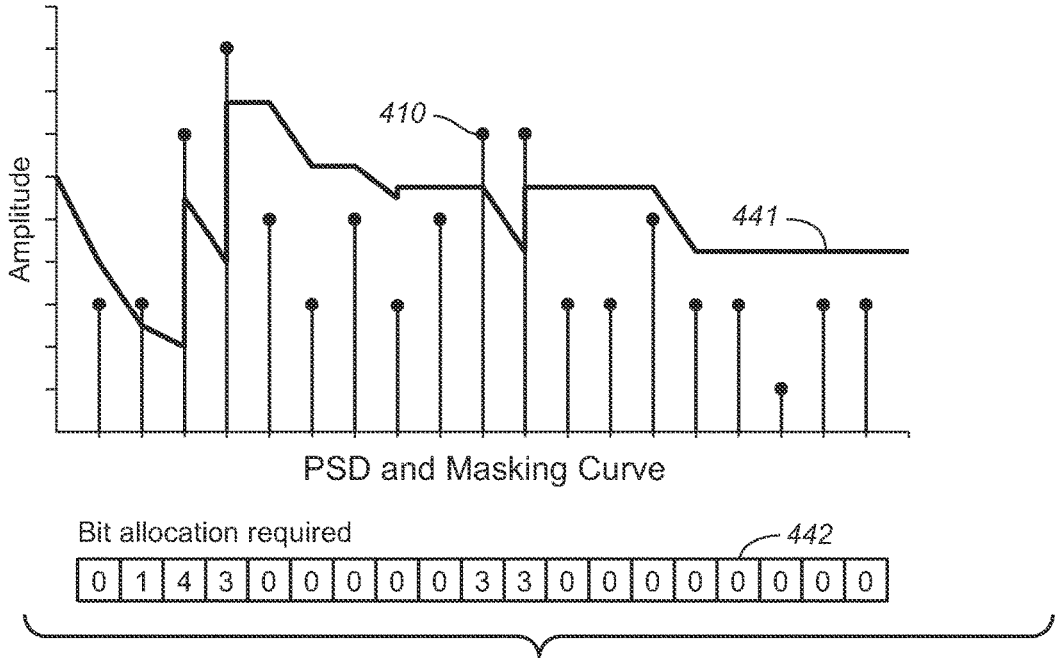

The overall frequency-domain masking curve 431 of FIG. 4*d* may be expanded back into the linear frequency resolution and may be compared to the linear PSD distribution 410 of a block of transform coefficients 402 shown in FIG. 4*b*. This is illustrated in FIG. 4*e* which shows the frequency-domain masking curve 441 on a linear resolution, as well as the PSD distribution 410 on a linear resolution. It should be noted that the frequency-domain masking curve 441 may also take into account the absolute threshold of hearing curve. The number of bits for encoding the mantissa of the transform coefficients 402 of a particular frequency bin may be determined based on the PSD distribution 410 and based on the masking curve 441. In particular, PSD values of the PSD distribution 410 which fall below the masking curve 441 correspond to mantissas that are perceptually irrelevant (because the frequency component of the audio signal in such frequency bins is masked by a masker frequency in its vicinity). By consequence, the mantissas of such transform coefficients 402 do not need to be assigned any bits at all. On the other hand, PSD values of the PSD distribution 410 that are above the masking curve 441 indicate that the mantissas of the transform coefficients 402 in these frequency bins should be assigned bits for encoding. The number of bits assigned to such mantissas should increase with increasing difference between the PSD value of the PSD distribution 410 and the value of the masking curve 441. The above mentioned bit allocation process results in an allocation 442 of bits to the different transform coefficients 402 as shown in FIG. 4*e*.

The above mentioned bit allocation process is performed for all channels (e.g., the direct channels, the LFE channel and the coupling channel) and for all blocks of the audio frame, thereby yielding an overall (preliminary) number of allocated bits. It is unlikely that this overall preliminary number of allocated bits matches (e.g., is equal to) the total number of available mantissa bits. In some cases (e.g., for complex audio signals), the overall preliminary number of allocated bits may exceed the number of available mantissa bits (bit starvation). In other cases (e.g., in case of simple audio signals), the overall preliminary number of allocated bits may lie below the number of available mantissa bits (bit surplus). The encoder 300 typically tries to match the overall (final) number of allocated bits as close as possible to the number of available mantissa bits. For this purpose, the encoder 300 may make use of a so called SNR offset parameter. The SNR offset allows for an adjustment of the masking curve 441, by moving the masking curve 441 up or down relative to the PSD distribution 410. By moving up or down the masking curve 441, the (preliminary) number of allocated bits can be decreased or increased, respectively. As such, the SNR offset may be adjusted in an iterative manner until a termination criteria is met (e.g., the criteria that the preliminary number of allocated bits is as close as possible to (but below) the number of available bits; or the criteria that a predetermined maximum number of iterations has been performed).

As indicated above, the iterative search for an SNR offset which allows for a best match between the final number of allocated bits and the number of available bits may make use of a binary search. At each iteration, it is determined if the preliminary number of allocated bits exceeds the number of available bits or not. Based on this determination step, the SNR offset is modified and a further iteration is performed. The binary search is configured to determine the best match (and the corresponding SNR offset) using ($\log_2(K)+1$) iterations, wherein K is the number of possible SNR offsets. After termination of the iterative search a final number of allocated bits is obtained (which typically corresponds to one of the previously determined preliminary numbers of allocated bits). It should be noted that the final number of allocated bits may be (slightly) lower than the number of available bits. In such cases, skip bits may be used to fully align the final number of allocated bits to the number of available bits.

The SNR offset may be defined such that an SNR offset of zero leads to encoded mantissas which lead to an encoding condition known as "just-noticeable difference" between the original audio signal and the encoded signal. In other words, at an SNR offset of zero the encoder 300 operates in accordance to the perceptual model. A positive value of the SNR offset may move the masking curve 441 down, thereby increasing the number of allocated bits (typically without any noticeable quality improvement). A negative value of the SNR offset may move the masking curve 441 up, thereby decreasing the number of allocated bits (and thereby typically increasing the audible quantization noise). The SNR offset may e.g., be a 10-bit parameter with a valid range from −48 to +144 dB. In order to find the optimum SNR offset value, the encoder 300 may perform an iterative binary search. The iterative binary search may then require up to 11 iterations (in case of a 10-bit parameter) of PSD distribution 410/masking curve 441 comparisons. The actually used SNR offset value may be transmitted as a bit allocation parameter 315 to the corresponding decoder. Furthermore, the mantissas are encoded in accordance to the (final) allocated bits, thereby yielding a set of encoded mantissas 317.

As such, the SNR (Signal-to-Noise-Ratio) offset parameter may be used as an indicator of the coding quality of the encoded multi-channel audio signal. According to the above mentioned convention of the SNR offset, an SNR offset of zero indicates an encoded multi-channel to audio signal having a "just-noticeable difference" to the original multi-channel audio signal. A positive SNR offset indicates an encoded multi-channel audio signal which has a quality of at least the "just-noticeable difference" to the original multi-channel audio signal. A negative SNR offset indicates an encoded multi-channel audio signal which has a quality low than the "just-noticeable difference" to the original multi-channel audio signal. It should be noted that other conventions of the SNR offset parameter may be possible (e.g., an inverse convention).

The encoder 300 further comprises a bitstream packing unit 307 which is configured to arrange the encoded exponents 313, the encoded mantissas 317, the bit allocation parameters 315, as well as other encoding data (e.g., block switch flags, metadata, coupling scale factors, etc.) into a predetermined frame structure (e.g., the AC-3 frame structure), thereby yielding an encoded frame 318 for an audio frame of the multi-channel audio signal.

As already outlined above, and as shown in FIG. 1*a*, 7.1 DD+ streams are typically encoded by independently encoding a basic group 121 of channels using an IS encoder 105, thereby yielding the IS 110 and an extension group 122 of channels using a DS encoder 106, thereby yielding the DS 120. The IS encoder 105 and the DS encoder 106 are provided typically with a fixed portion of the total data-rate, i.e. each encoder 105, 106 performs an independent bit allocation process without any interaction between the two encoders 105, 106. Typically, the IS encoder 105 is assigned X % of the total data-rate and the DS encoder 106 is provided with 100-X % of the total data-rate, wherein X is a fixed value, for example, X=50.

Figure 5A:
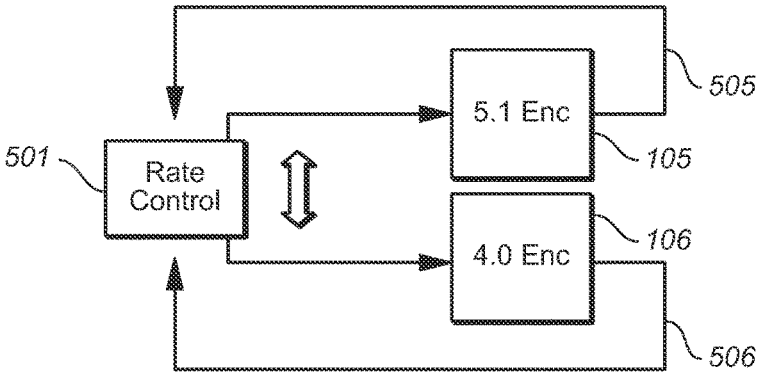
FIG. 5*a* shows a block diagram of an example multi-channel audio encoder comprising joint rate control.

As described above, the multi-channel encoder 300 adjusts the SNR offset such that the total (final) number of allocated bits matches (as close as possible) the total number of available bits. In the context of this bit allocation process, the SNR offset may be adjusted (e.g., increased/decreased) such that the number of allocated bits is increased/decreased. However, if the encoder 300 allocates more bits than are required to achieve the "just-noticeable difference", the additionally allocated bits are actually wasted, because the additionally allocated bits typically do not lead to an improvement of the perceived quality of the encoded audio signal. In view of this, it is proposed to provide a flexible and combined bit allocation process for the IS encoder 105 and for the DS encoder 106, thereby allowing the two encoders 105, 106 to dynamically adjust the fraction of the total data-rate for the IS encoder 105 (referred to as the "IS data-rate") and the fraction of the total data-rate for the DS encoder 106 (referred to as the "DS data-rate") along the time line (in accordance to the requirements of the multi-channel audio signal). The IS data-rate and the DS data-rate are preferably adjusted such that their sum corresponds to the total data-rate at all times. The combined bit allocation process is illustrated in FIG. 5*a*. FIG. 5*a* shows the IS encoder 105 and the DS encoder 106. Furthermore, FIG. 5*a* shows a rate control unit 501 which is configured to determine the IS data-rate and the DS data-rate based on output data 505 fed back from the IS encoder 105 and based on output data 506 fed back from the DS encoder 106. The output data 505, 506 may, for example, be the encoded IS 110 and the encoded DS 120, respectively; and/or the SNR offset of the respective encoder 105, 106. As such, the rate control unit 501 may take into account output data 505, 506 from the two encoders 105, 106 for dynamically determining the IS data-rate and the DS data-rate. In a preferred embodiment, the variable assignment of the IS data-rate and the DS data-rate is performed such that the variable assignment has no impact on the corresponding multi-channel audio decoder system 200, 210. In other words, the variable assignment should be transparent to the corresponding multi-channel audio decoder system 200, 210.

A possible way to implement a variable assignment of the IS/DS data-rates is to implement a shared bit allocation process for allocating the mantissa bits. The IS encoder 105 and the DS encoder 106 may independently perform encoding steps which precede the mantissa bit allocation process (performed in the bit allocation unit 305). In particular, the encoding of block switch flags, coupling scale factors, exponents, spectral extension, etc. may be performed in an independent manner in the IS encoder 105 and in the DS encoder 106. On the other hand, the bit allocation process performed in the respective units 305 of the IS encoder 105 and the DS encoder 106 may be performed jointly. Typically around 80% of the bits of the IS and the DS are used for the encoding of the mantissas. Consequently, even though the IS and DS encoder 105, 106 work independently for the encoding other than mantissa bit allocation, the significant part of the encoding (i.e. the mantissa bit allocation) is performed jointly.

In other words, it is proposed to encode the 'fixed' data of each group of channels independently (e.g., the exponents, coupling coordinates, spectral extension, etc.). Subsequently, a single bit allocation process is performed for the basic group 121 and the extension group 122 using the total of the remaining bits. Then, the mantissas of both streams are quantized and packed to yield the encoded frames 151 of the IS (referred to as the IS frames 151) and the encoded frames 152 of the DS (referred to as the DS frames 152). As a result of the combined bit allocation process, the IS frames 151 may vary in size along the time line (due to a varying IS data-rate). In a similar manner, the DS frames 152 may vary in size along the time line (due to a varying IS data-rate). However, for each time slice 170 (i.e., for each audio frame of the multi-channel audio signal) the sum of the size of the IS frame(s) 151 and the DS frame(s) 152 should be substantially constant (due to a constant total data-rate). Furthermore, as a result of the combined bit allocation process, the SNR offset of the IS and the DS should be identical, because the joint bit allocation process performed in a joint bit allocation unit 305 adjusts a joint SNR offset in order to match the number of allocated mantissa bits (jointly for the IS and the DS) with the number of available mantissa bits (jointly for the IS and the DS). The fact of having identical SNR offsets for the IS and DS should improve the overall quality by allowing the most bit-starved substream (e.g., the IS) to use extra bits if and when the other substream (e.g., the DS) is in surplus.

Figure 5B:
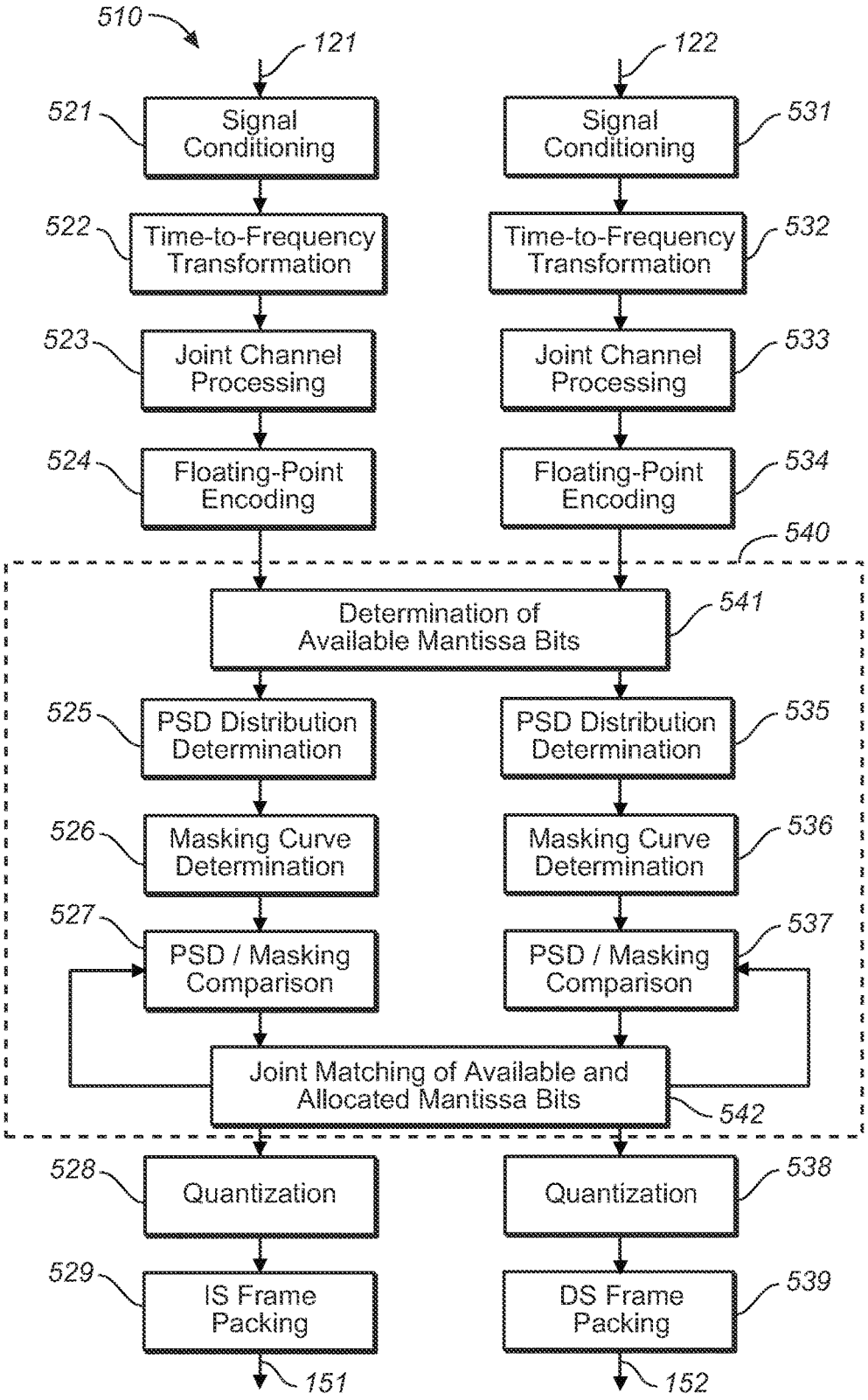
FIG. 5*b* shows a flow chart of an example multi-channel encoding scheme.

FIG. 5*b* illustrates the flow chart of an example combined IS/DS encoding method 510. The method comprises separate signal conditioning steps 521, 531 for the signal frames of the basic group 121 and of the extension group 122, respectively. The method 510 proceeds with separate Time-to-Frequency Transformation steps 522, 532 for the blocks from the basic group 121 and for the blocks from the extension group 122, respectively. Subsequently, joint channel processing steps 523, 533 may be performed for the basic group 121 and the extension group 122, respectively. By way of example, in case of the basic group 121, the Lst and Rst channels or all of the channels (except the LFE channel) may be coupled (step 523), wherein for the extension group 122, the Ls and Rs, and/or the Lb and Rb channels may be coupled (step 533), thereby yielding respective coupled channels and coupling parameters.

Furthermore, Block Floating-Point Encoding 524, 534 may be performed for the blocks of the basic group 121 and for the blocks of the extension group 122, respectively. As a result, encoded exponents 313 are obtained for the basic group 121 and for the extension group 122, respectively. The above mentioned processing steps may be performed as outlined in the context of FIG. 3.

The method 510 comprises a joint bit allocation step 540. The joint bit allocation 540 comprises a joint step 541 for determining the available mantissa bits, i.e. for determining the total number of bits which are available to encode the mantissas of the basic group 121 and of the extension group 122. Furthermore, the method 510 comprises PSD distribution determination steps 525, 535 for the blocks of the basic group 121 and for the blocks of the extension group 122, respectively. In addition, the method 510 comprises masking curve determination steps 526, 536 for the basic group 121 and the extension group 122, respectively. As outlined above, the PSD distributions and the masking curves are determined for each channel of the multi-channel signal and for each block of a signal frame. In the context of the PSD/masking comparison steps 527, 537 (for the basic group 121 and the extension group 122, respectively) the PSD distributions and the masking curves are compared and bits are allocated to the mantissas of the basic group 121 and the extension group 122, respectively. These steps are performed for each channel and for each block. Furthermore, these steps are performed for a given SNR offset (which is equal for the PSD/masking comparison steps 527 and 537.

Subsequent to the allocation of bits to the mantissas using a given SNR offset, the method 510 proceeds with the joint matching step 542 of determining the total number of allocated mantissa bits. Furthermore, it is determined in the context of step 542 whether the total number of allocated mantissa bits matches the total number of available mantissa bits (determined in step 541). If an optimal match has been determined, the method 510 proceeds with the quantization 528, 538 of the mantissas of the basic group 121 and the extension group 122, respectively, based on the allocation of mantissa bits determined in steps 527, 537. Furthermore, the IS frames 151 and the DS frames 152 are determined in the bitstream packing steps 529, 539, respectively. On the other hand, if an optimal match has not yet been determined, the SNR offset is modified and the PSD/masking comparison steps 527, 537 and the matching step 542 are repeated. The steps 527, 537 and 542 are iterated, until an optimal match is determined and/or until a termination condition is reached (e.g., a maximum number of iterations).

It should be noted that the PSD determination steps 525, 535, the masking curve determination steps 526, 536 and the PSD/masking comparison steps 527, 537 are performed for each channel of the multi-channel signal and for each block of a signal frame. Consequently, these steps are (by definition) performed separately for the basic group 121 and for the extension group 122. As a matter of fact, these steps are performed separately for each channel of the multi-channel signal.

Overall, the encoding method 510 leads to an improved allocation of the data-rates to the IS and to the DS (compared to a separate bit allocation process). As a consequence, the perceived quality of the encoded multi-channel signal (comprising an IS and at least one DS) is improved (compared to an encoded multi-channel signal encoded using separate IS and DS encoders 105, 106).

It should be noted that the IS frames 151 and the DS frames 152 which are generated by the method 510 may be arranged in a manner which is compatible with the IS frames and DS frames generated by the separate IS and DS encoders 105, 106, respectively. In particular, the IS and DS frames 151, 152 may each comprise bit allocation parameters which allow a conventional multi-channel decoder system 200, 210 to separately decode the IS and DS frames 151, 152. In particular, the (same) SNR offset value may be inserted into the IS frame 151 and into the DS frame 152. Hence, a multi-channel encoder based on the method of 510 may be used in conjunction with conventional multi-channel decoder systems 200, 210.

It may be desirable to use a standard IS encoder 105 and a standard DS encoder 106 for encoding the basic group 121 and the extension group 122, respectively. This may be beneficial for cost reasons. Furthermore, in certain situations it may not be possible to implement a joint bit allocation process 540 as described in the context of FIG. 5*b*. Nevertheless, it is desirable to allow for the adaptation of the IS data-rate and the DS data-rate to the multi-channel audio signal and to thereby improve the overall quality of the encoded multi-channel audio signal.

In order to allow for an adaption of the IS data-rate and the DS data-rate without modifying to the IS encoder 105 and the DS encoder 106, the IS data-rate and the DS data-rate may be controlled externally to the IS/DS encoders 105, 106, for example, based on the estimated relative stream coding difficulty for a particular frame. The relative coding difficulty for a particular frame may be estimated, for example, based on the perceptual entropy, based on the tonality or based on the energy. The coding difficulty may be computed based on the encoder input PCM samples relevant for the current frame to be encoded. This may require a correct time alignment of the PCM samples according to any subsequent encoding time delay (e.g., caused by an LFE filter, a HP filter, a 90° phase shifting of Left and Right Surround channels and/or Temporal Pre Noise Processing (TPNP)). Examples for indicators of the coding difficulty may be the signal power, the spectral flatness, the tonality estimates, transient estimates and/or perceptual entropy. The perceptual entropy measures the number of required bits to encode a signal spectrum with quantization noise just below the masking threshold. A higher value for perceptual entropy indicates a higher coding difficulty. Sounds with tonal character (i.e., sounds having a high tonality estimate) are typically more difficult to encode as reflected, for example, in the masking curve computation of the ISO/IEC 11172-3 MPEG-1 Psychoacoustic Model. As such, a high tonality estimate may indicate a high coding difficulty (and vice versa). A simple indicator for coding difficulty may be based on the average signal power of the basic group of channels and/or the extension groups of channels.

The estimated coding difficulty of a current frame of the basic group and the corresponding current frame of the extension group may be compared and the IS data-rate/DS data-rate (and the respective mantissa bits) may be distributed accordingly. One possible formula for determining the DS data-rate/IS data-rate may be:

$$R_{IS} = R_T\left(\frac{(D_{IS}N_{IS})}{(D_{IS}N_{IS} + D_{DS}N_{DS})}\right) \text{ and } R_{DS} = R_T\left(\frac{(D_{DS}N_{DS})}{(D_{IS}N_{IS} + D_{DS}N_{DS})}\right)$$

wherein $R_{DS}$ is the DS data-rate, $R_T$ is the total data-rate, $R_{IS}$ is the IS data-rate, $D_{IS}$ is the coding difficulty of a channel of the basic group (e.g., an average coding difficulty of the channels of the basic group), $D_{DS}$ is the coding difficulty of a channel of the extension group (e.g., an average coding difficulty of the channels of the extension group), $N_{IS}$ is the number of channels in the basic group, and $N_{DS}$, is the number of channels in the extension group.

The determined DS and IS data-rates may be determined such that the number of bits for the IS and/or the DS does not fall below a fixed minimum number of bits for an IS frame and/or for a DS frame. As such, a minimum quality may be ensured for the IS and/or DS. In particular, the fixed minimum number of bits for an IS frame and/or for a DS frame may be limited by the number of bits required to encode all data apart from the mantissas (e.g., the exponents, etc.).

In another approach, the median (or mean) coding difficulty difference (IS vs. DS) may be determined on a large set of relevant multi-channel content. The control of the data-rate distribution may be such that for typical frames (having a coding difficulty difference within a pre-determined range of the median coding difficulty difference) a default data-rate distribution is used (e.g., X % and 100%−X %). Otherwise, the data-rate distribution may deviate from the default in accordance to the deviation of the actual coding difficulty difference from the median coding difficulty difference.

Figure 5C:
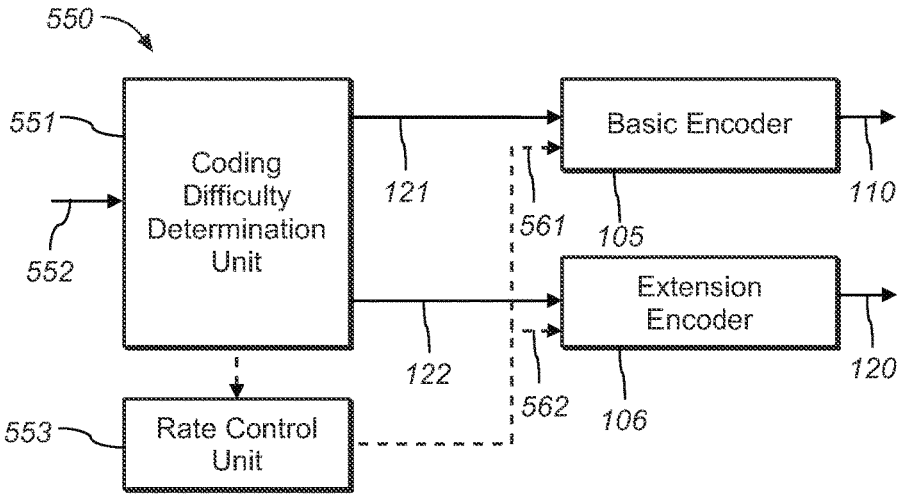
FIG. 5*c* shows a block diagram of a further example multi-channel audio encoder comprising joint rate control.

An encoder 550 which adapts the IS data-rate and the DS data-rate based on coding difficulty is illustrated in FIG. 5*c*. The encoder 550 comprises a coding difficulty determination unit 551 which receives the multi-channel audio signal 552 (and/or the basic group 121 of channels and the extension group 122 of channels). The coding difficulty determination unit 551 analyzes respective signal frames of the basic group 121 and of the extension group 122 and determines a relative coding difficulty of the frames of the basic group 121 and of the extension group 122. The relative coding difficult is passed to the rate control unit 553 which is configured to determine the IS data-rate 561 and the DS data-rate 562 based on the relative coding difficulty. By way of example, if the relative coding difficulty indicates a higher coding difficulty for the basic group 121 compared to the extension group 122, the IS data-rate 561 is increased and the DS data-rate 562 is decreased (and vice versa).

Another approach for an adaption of the IS data-rate and the DS data-rate without modifying the IS encoder 105 and the DS encoder 106 is to extract one or more encoder parameters from the IS/DS frames 151, 152 and to use the one or more encoder parameters to modify the IS data-rate and the DS data-rate. By way of example, the extracted one or more encoder parameters of the IS/DS frames 151, 152 of a signal frame (n−1) may be taken into account to determine the IS/DS data-rates for encoding the succeeding signal frame (n). The one or more encoder parameters may be related to the perceptual quality of the encoded IS 110 and the encoded DS 120. By way of example, the one or more encoder parameters may be the DD/DD+SNR offset used in the IS encoder 105 (referred to as the IS SNR offset) and the SNR offset used in the DS encoder 106 (referred to as the DS SNR offset). As such, the IS/DS SNR offsets taken from the previous IS/DS frames 151, 152 (at time instant (n−1)) may be used to adaptively control the IS/DS data-rates for the succeeding signal frame (at time instant (n)), such that the IS/DS SNR offsets are equalized across the multi-channel audio signal stream. In more generic terms, it may be stated that the one or more encoder parameters taken from the IS/DS frames 151, 152 (at time instant (n−1)) may be used to adaptively control the IS/DS data-rates for the succeeding signal frame (at time instant (n)), such that the one or more encoder parameters are equalized across the multi-channel audio signal stream. Hence, the goal is to provide the same quality for the different groups of the encoded multi-channel signal. In other words, the goal is to ensure that the quality of the encoded substreams is as close as possible for all the substreams of a multi-channel audio signal stream. This goal should be achieved for each frame of the audio signal i.e. for all time instants or for all frames of the signal.

Figure 6:
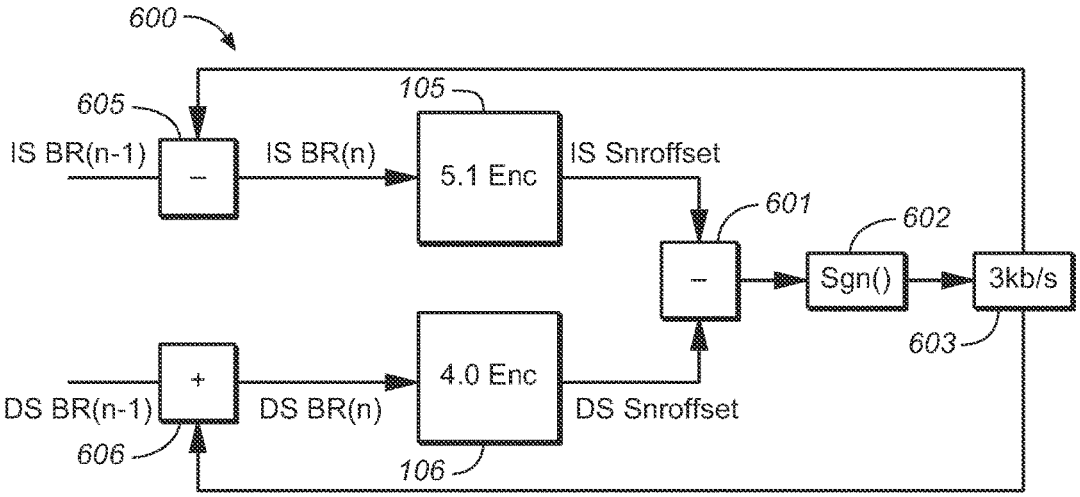
FIG. 6 shows a block diagram of another example multi-channel audio encoder comprising joint rate control.

FIG. 6 shows a block diagram of an example encoder 600 comprising an external IS/DS data-rate adaptation scheme. The encoder 600 comprises an IS encoder 105 and a DS encoder 106 which may be configured in accordance to the encoder 300 illustrated in FIG. 3. For a signal frame (n−1) and for an assigned IS data-rate(n−1) and DS data-rate(n−1) at time instant or frame number (n−1), the IS/DS encoders 105, 106 provide an encoded IS frame(n−1) and an encoded DS frame (n−1), respectively. The IS encoder 105 uses the IS SNR offset(n−1) and the DS encoder 106 uses the DS SNR offset(n−1) for allocating the IS data-rate(n−1) and the DS data-rate(n−1) to the mantissas, respectively. The IS SNR offset(n−1) and the DS SNR offset(n−1) may be extracted from the IS frame(n−1) and the DS frame(n−1), respectively. In order to ensure an alignment between the IS SNR offset and the DS SNR offset across the stream (i.e. along the frame numbers (n)), the IS SNR offset(n−1) and the DS SNR offset(n−1) may be fed back to the input of the IS/DS encoders 105, 106, in order to adapt the IS data-rate (n) and the DS data-rate(n) for encoding the succeeding signal frame (n).

In particular, the encoder 600 comprises an SNR offset deviation unit 601 configured to determine a difference between the IS SNR offset(n−1) and the DS SNR offset(n−1). The difference may be used to control the IS/DS data-rates(n) (for the succeeding signal frame). In an embodiment, an IS SNR offset(n−1) which is smaller than the DS SNR offset(n−1) (i.e., a difference which is negative) indicates that the perceptual quality of the IS is most likely lower than the perceptual quality of the DS. Consequently, the DS data-rate(n) should be decreased with respect to the DS data-rate(n−1), in order to decrease the perceptual quality of the IS (or possibly leave unaffected) in the succeeding signal frame (n). At the same time, the IS data-rate(n) should be increased with respect to the IS data-rate(n−1), in order to increase the perceptual quality of the IS in the succeeding signal frame (n) and also to fulfill the total data rate requirement. The modification of the IS data-rate(n) based on the IS SNR offset(n−1) is based on the assumption that the coding difficulty as reflected by the IS SNR offset(n−1) parameter does not change significantly between two succeeding frames. In a similar manner, an IS SNR offset(n−1) which is greater than the DS SNR offset(n−1) (i.e. a difference which is positive) may indicate that the perceptual quality of the IS is higher than the perceptual quality of the DS. The IS data-rate(n) and the DS data-rate(n) may be modified with respect to the IS data-rate(n−1) and the DS data-rate(n−1) such that the perceptual quality of the IS is reduced (or left unaffected) and the perceptual quality of the DS is increased.

The above mentioned control mechanism may be implemented in various ways. The encoder 600 comprises a sign determination unit 602 which is configured to determine the sign of the difference between the IS SNR offset(n−1) and the DS SNR offset(n−1). Furthermore, the encoder 600 makes use of a predetermined data-rate offset 603 (e.g., a percentage of the total available data-rate, for example, around 0.5%, 1%, 2%, 3%, 4%, 5% or 10% of the total available data-rate) which may be applied to modify the IS data-rate(n) and the DS data-rate(n) with respect to the IS data-rate(n−1) and the DS data-rate(n−1) in the IS rate modification unit 605 and in the DS rate modification unit 606. By way of example, if the difference is negative, the IS rate modification unit 605 determines IS data-rate(n)=IS data-rate(n−1)+ data-rate offset, and the DS rate modification unit 606 determines DS data-rate(n)=DS data-rate(n−1)−data-rate offset (and vice versa in case of a positive difference).

The above mentioned external control scheme for adapting the assignment of the total data-rate to the IS data-rate and to the DS data-rate is directed at reducing the difference between the IS SNR offset and the DS SNR offset. In other words, the above mentioned control scheme tries to align the IS SNR offset and the DS SNR offset, thereby aligning the perceived quality of the encoded IS and the encoded DS. As a result, the overall perceived quality of the encoded multi-channel signal (comprising the encoded IS and the encoded DS) is improved (compared to the encoder 100 which uses fixed IS/DS data-rates).

In the present document, methods and systems for encoding a multi-channel audio signal have been described. The methods and systems encode the multi-channel audio signal into a plurality of substreams, wherein the plurality of substreams enables an efficient decoding of different combinations of channels of the multi-channel audio signal. Furthermore, the methods and systems allow for a joint allocation of mantissa bits across a plurality of substreams, thereby increasing the perceived quality of the encoded (and subsequently decoded) multi-channel audio signal. The methods and systems may be configured such that the encoded substreams are compatible with legacy multi-channel audio decoders.

In particular, the present document describes the transmission of 7.1 channels in DD+ within two substreams, wherein a first "independent" substream comprises a 5.1 channel mix, and a second "dependent" substream comprises the "extention" and/or "replacement" channels. Currently, encoding of 7.1 streams is typically performed by two core 5.1 encoders that have no knowledge of each other. The two core 5.1 encoders are given a data-rate—a fixed portion of the total available data-rate—and perform encoding of the two substreams independently.

In the present document, it has been proposed to share mantissa bits between the (at least) two substreams. In an embodiment, the 'fixed' data of each stream is encoded independently (exponents, coupling coordinates, etc). Subsequently, a single bit allocation process is performed for both streams with the remaining bits. Finally, the mantissas of both streams may be quantized and packed. Doing this, each timeslice of an encoded signal is identical in size, but individual encoded frames (e.g., IS frame and/or DS frames) may vary. Also, the SNR Offset of the independent and dependent streams may be identical (or their difference may be reduced). By doing this, the overall encoding quality may be improved by allowing the most bit-starved substream to use extra bits if/when the other substream is in surplus.

It should be noted that while the methods and systems have been described in the context of a 7.1 DD+ audio encoder, the methods and systems are applicable to other encoders that create DD+ bitstreams comprising multiple substreams. Furthermore, the methods and systems are applicable to other audio/video codecs that utilize the concept of a bit pool, multiple substreams and that have a constraint on the overall data-rate (e.g., that require a constant data-rate). Audio/video codecs which operate on related substreams may apply a shared bit pool to allocate bits to the related substreams as-needed, and vary the substream data-rates while keeping the total data-rate constant.

The methods and systems described in the present document may be implemented as software, firmware and/or hardware. Certain components may, for example, be implemented as software running on a digital signal processor or microprocessor. Other components may, for example, be implemented as hardware and or as application specific integrated circuits. The signals encountered in the described methods and systems may be stored on media such as random access memory or optical storage media. They may be transferred via networks, such as radio networks, satellite networks, wireless networks or wireline networks, such as the Internet. Typical devices making use of the methods and systems described in the present document are portable electronic devices or other consumer equipment which are used to store and/or render audio signals.

The invention claimed is:

1. An audio encoder configured to encode a multi-channel audio signal according to a total available data-rate; wherein the multi-channel audio signal is representable as a basic group of channels for rendering the multi-channel audio signal in accordance to a basic channel configuration, and as an extension group of channels, which —in combination with the basic group —is for rendering the multi-channel audio signal in accordance to an extended channel configuration; wherein the basic channel configuration and the extended channel configuration are different from one another; the audio encoder comprising a basic encoder configured to encode the basic group of channels according to an IS data-rate, thereby yielding an independent substream, referred to as IS;

an extension encoder configured to encode the extension group of channels according to a DS data-rate, thereby yielding a dependent substream, referred to as DS; and a data rate controller that regularly adapts the IS data-rate and the DS data-rate based on a momentary IS coding quality indicator for the basic group of channels and/or based on a momentary DS coding quality indicator for the extension group of channels, such that the sum of the IS data-rate and the DS data-rate substantially corresponds to the total available data-rate.

2. The encoder of claim 1, wherein the data rate controller is configured to determine the IS data-rate and the DS data-rate such that a difference between the momentary IS coding quality indicator and the momentary DS coding quality indicator is reduced.

3. The encoder of claim 1, wherein the basic encoder and the extension encoder are frame-based audio encoders configured to encode a sequence of frames of the multi-channel audio signal, thereby yielding corresponding sequences of IS frames and DS frames of the independent substream and the dependent substream, respectively.

4. The encoder of claim 3, wherein the data rate controller is configured to adapt the IS data-rate and the DS data-rate for each frame of the sequence of frames of the multi-channel audio signal.

5. The encoder of claim 3, wherein the IS coding quality indicator comprises a sequence of IS coding quality indicators for the corresponding sequence of IS frames;

the DS coding quality indicator comprises a sequence of DS coding quality indicators for the corresponding sequence of DS frames;

the rate controller is configured to determine the IS data-rate for an IS frame of the sequence of IS frames and the DS data-rate for a DS frame of the sequence of DS frames based on the sequence of IS coding quality indicators and the sequence of DS coding quality indicators, such that the sum of the IS data-rate for the IS frame and the DS data-rate for the DS frame is substantially the total available data-rate.

6. A method for encoding a multi-channel audio signal according to a total available data-rate; wherein the multi-channel audio signal is representable as a basic group of channels for rendering the multi-channel audio signal in accordance to a basic channel configuration, and as an extension group of channels, which —in combination with the basic group —is for rendering the multi-channel audio signal in accordance to an extended channel configuration; wherein the basic channel configuration and the extended channel configuration are different from one another; the method comprising encoding the basic group of channels according to an IS data-rate, thereby yielding an independent substream, referred to as IS;

encoding the extension group of channels according to a DS data-rate, thereby yielding a dependent substream, referred to as DS; and regularly adapting the IS data-rate and the DS data-rate based on a momentary IS coding quality indicator for the basic group of channels and/or based on a momentary DS coding quality indicator for the extension group of channels, such that the sum of the IS data-rate and the DS data-rate substantially corresponds to the total available data-rate.

7. The method of claim 6, further comprising determining the IS coding quality indicator based on one or more frames of the basic group of channels, and/or determining the DS coding quality indicator based on one or more corresponding frames of the extension group of channels.

8. A non-transitory computer readable medium containing a software program adapted for execution on a processor and for performing the method steps of claim 6 when carried out on the processor.

9. A non-transitory storage medium comprising a software program adapted for execution on a processor and for performing the method steps of claim 6 when carried out on the processor.

10. A non-transitory computer readable medium containing a computer program product comprising executable instructions for performing the method steps of claim 6 when executed on a computer.

11. A method for decoding encoded audio data, including the steps of:

receiving a signal indicative of the encoded audio data; and decoding the encoded audio data to generate a signal indicative of the audio data, wherein the encoded audio data have been generated by:

(a) encoding a basic group of channels according to an IS data-rate, thereby yielding an independent substream;

(b) encoding an extension group of channels according to a DS data-rate, thereby yielding a dependent substream; and (c) regularly adapting the IS data-rate and the DS data-rate based on a momentary IS coding quality indicator for the basic group of channels and/or based on a momentary DS coding quality indicator for the extension group of channels, such that the sum of the IS data-rate and the DS data-rate substantially corresponds to a total available data-rate.

12. The method of claim 11, wherein the encoded audio data have been further generated by determining the momentary IS coding quality indicator based on an excerpt of the basic group of channels, and/or determining the momentary DS coding quality indicator based on a corresponding excerpt of the extension group of channels.

13. A non-transitory computer readable medium containing a software program adapted for execution on a processor and for performing the method steps of claim 11 when carried out on the processor.

14. A non-transitory storage medium comprising a software program adapted for execution on a processor and for performing the method steps of claim 11 when carried out on the processor.

15. An audio decoder configured to decode audio data in accordance with the method steps of claim 11.

* * * * *